US008302339B2

(12) United States Patent
Pender et al.

(10) Patent No.: US 8,302,339 B2
(45) Date of Patent: Nov. 6, 2012

(54) DISPLAY SYSTEM

(76) Inventors: Randy Pender, Woodbury, GA (US); Van Stry Erik, Winchester, MA (US)

( * ) Notice: Subject to any disclaimer, the term of this patent is extended or adjusted under 35 U.S.C. 154(b) by 0 days.

(21) Appl. No.: 12/220,250

(22) Filed: Jul. 23, 2008

(65) Prior Publication Data

US 2008/0282587 A1 Nov. 20, 2008

Related U.S. Application Data

(63) Continuation of application No. 11/220,428, filed on Sep. 7, 2005, now abandoned.

(51) Int. Cl.

| | |
|---|---|
| ***A47G 1/06*** | (2006.01) |
| ***A47G 1/16*** | (2006.01) |
| ***G09F 3/18*** | (2006.01) |
| ***G09F 7/00*** | (2006.01) |
| ***G09F 15/00*** | (2006.01) |
| ***G09F 15/02*** | (2006.01) |
| ***G09F 3/08*** | (2006.01) |

(52) U.S. Cl. ..... 40/729; 40/772; 40/757; 40/730; 40/649; 40/605; 40/759; 40/610; 40/607.02; 40/607.1; 40/661.05; 40/663; 248/220.22; 248/220.42; 248/544; 248/496; 211/22; 211/24; 211/33; 211/37; 211/133.1; 211/194; 211/199

(58) Field of Classification Search ..... 40/729, 40/772, 757, 730, 649, 605, 759, 610, 607.02, 40/607.1, 661.05, 663; 248/220.22, 220.42, 248/544, 496; 211/22, 24, 33, 37, 133.1, 211/194, 199

See application file for complete search history.

(56) References Cited

U.S. PATENT DOCUMENTS

| | | | | |
|---|---|---|---|---|
| 4,113,109 | A * | 9/1978 | Donnelli et al. | 211/49.1 |
| 4,115,938 | A * | 9/1978 | Belmuth et al. | 40/730 |
| 4,144,664 | A * | 3/1979 | De Korte | 40/609 |
| 4,458,873 | A * | 7/1984 | Sutherland | 248/544 |
| 4,566,211 | A * | 1/1986 | Gustafson et al. | 40/605 |
| 5,659,991 | A * | 8/1997 | Kennedy | 40/729 |
| 5,713,146 | A * | 2/1998 | Reeves, Sr. | 40/611.06 |
| 6,009,930 | A * | 1/2000 | Jantschek | 160/135 |
| 6,105,292 | A * | 8/2000 | Current | 40/605 |
| 6,553,704 | B1 * | 4/2003 | Pigg | 40/734 |

* cited by examiner

*Primary Examiner* — Lesley D Morris
*Assistant Examiner* — Syed A Islam
(74) *Attorney, Agent, or Firm* — Amster Rothstein & Ebenstein LLP

(57) ABSTRACT

A display system utilizing a graphics box as a primary component is disclosed. The graphics box greatly increases the flexibility and aesthetic appeal of displayed graphics cards. The ability to mass produce the graphics box, use multiple graphics boxes to deliver displays of different size and information content and, especially, the ability to reuse the graphics boxes, means that costs of the disclosed display system are relatively low and are achievable without a decrease in the aesthetic appeal of the entire display. Structures for supporting the graphics box to further increase the flexibility of the display system are also disclosed.

15 Claims, 10 Drawing Sheets

DISPLAY SYSTEM

BACKGROUND OF THE INVENTION

This invention relates to graphic display systems. The invention is more particularly concerned with economical, aesthetically pleasing and easily modifiable graphic display systems to be utilized primarily in retail stores.

Graphical display systems are used in many different ways to convey messages through words or images or through a combination of both words and images. Retail stores utilize graphical displays for many purposes, including informing customers as to available merchandise or special circumstances. These retail stores often need to modify their displays to reflect the season (e.g., "Back-to-School", "Happy Holidays", "Spring Savings") or other events (e.g., "SALE").

An often utilized display system has been large banners. These banners are typically one-time only use and expensive to print, distribute and install. Another often utilized display system includes freestanding signs which take up floor space and may not be very attractive. Ceiling hung signs are also often used, but these are particularly difficult and expensive to install. These and other alternative display systems are necessary to assure 'blanketing' of the store with the appropriate information. Some of these display systems may be more visually pleasing than others.

Each of these currently utilized display systems has inherent problems and, taken together, these distinct display options present an additional problem. Many different sizes and formats of the same information must be supplied to stores to fill the many different display elements and display spaces available. Each of these formats and sizes requires different art-direction, printing, shipping and installation considerations.

BRIEF SUMMARY OF THE INVENTION

The present invention seeks to solve many of the problems inherent in the conventional display systems and the use of a large number of display elements. The present invention utilizes a single, standardized graphical printing element, which can be referred to as a "graphics card". Graphics cards may be inserted into a standardized clear acrylic holder/display unit, which can be referred to as a "graphics box".

The graphics card can bear a stand alone message, e.g. "SALE", or a portion of a message, e.g. "S". Four graphics cards can be supplied ("S", "A", "L" and "E") and inserted into four graphics boxes. These four graphics boxes, e.g. placed side-by-side or stacked one on top of another, will spell out "SALE" four times as large as the single graphics box.

In addition, each graphics card can be treated as a picture element ("pixel") and a two-dimensional array (e.g., 2×2, 4×4, 4×10) of graphics boxes containing the graphics cards can then display a large picture or other display component, with or without text. Regardless of how the graphics cards are utilized, they can be of uniform size. This allows not only a great deal of flexibility but also a great deal of simplicity and efficiency in supplying a store or numerous stores with uniformly sized graphics cards all useable in a reusable graphics box based display system.

Thus, the reusable and reconfigurable graphics box allows for maximum flexibility of display choices balanced with minimum cost in changing displayed messages throughout a store. In addition, the cost savings does not reflect poorly on the overall quality and aesthetically pleasing nature of the display system. Because the most expensive element of the display system, i.e. the graphics box, may be reused many times, relatively expensive materials can be utilized in the construction of the graphics box. As a result, a pleasing aesthetic may be achieved at a reasonable per unit cost.

Some of the objects of the invention having been stated above, other objects will become evident as the description proceeds below, when taken in connection with the accompanying drawings as best described below.

DETAILED DESCRIPTION OF THE INVENTION

Figure 1A:
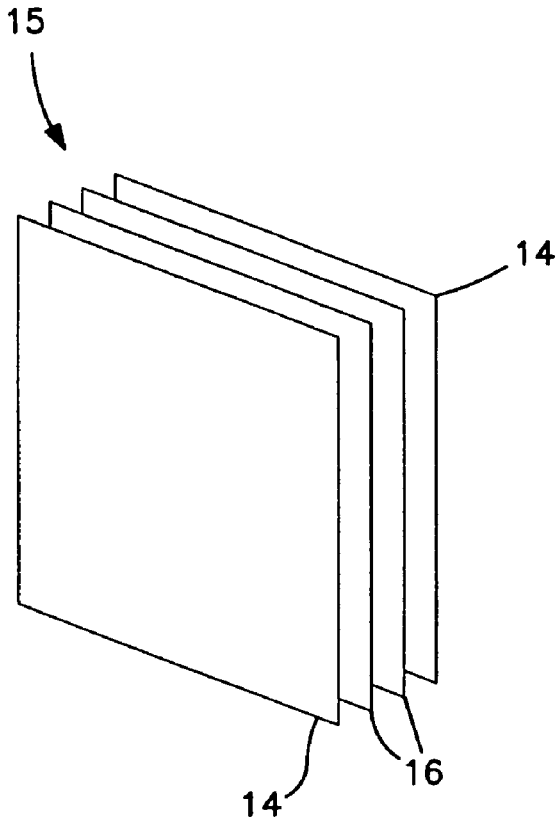
FIG. 1A is a perspective exploded view of display elements.
Figure 1B:
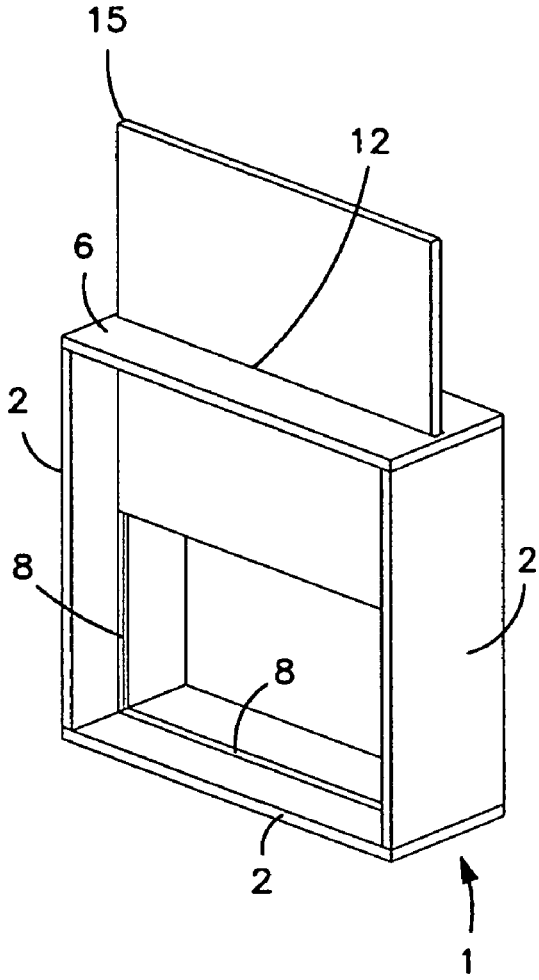
FIG. 1B is a perspective view of the display elements of FIG. 1A being inserted into the graphics box.

Referring first to FIG. 1B, there is shown the basic unit of the present retail display system, i.e. graphics box 1. Graphics box 1 is formed from four frame sections which are of a rigid material. One insertion frame section 6 is provided and three retention frame sections 2 are joined together at adjacent the extreme ends thereof. Any appropriate means of rigidly joining the ends of the insertion frame section 6 and the retention frame sections 2 may be used. Examples of frame joining techniques include glue, adhesive resin, welding and framing joinery.

The primary difference between insertion frame section 6 and retention frame sections 2 is the existence of a slot 12 extending completely through the insertion frame section 6. The retention frame sections 2 do not have a slot. However, the retentions frame sections 2 may be provided with a groove 8 of substantially the same width as slot 12 but only extending part of the way through the retention frame sections. If grooves 8 are provided in some or all of retention frame sections 2 they must be in alignment with each other and slot 12 in insertion frame section 6. The reason for this will be made clear below.

Shown in FIG. 1A are graphics cards 16 and display plates 14. One or more graphics cards 16 are sandwiched between display plates 14 and, when pressed together, form a box insert 15. The size of the graphics cards 16 and display plates 14, i.e. the box insert 15, are such that they are able to be inserted into slot 12. FIG. 1B discloses the box insert 15 being inserted into the graphics box 1.

As stated above, slot 12 and grooves 8 are in alignment with one another. In addition, the width of slot 12 and grooves 8 are of similar dimensions. The width of grooves 8 and alignment of the grooves 8 with slot 12, as well as with one another, allow the box insert 15 to be slid into place and effectively prevented from moving in any direction other than sliding in or out of the graphics box 1 through slot 12.

In an alternative embodiment of the invention, the graphics cards 16 alone are inserted into the graphics box 1, i.e. no display plates are utilized. Another alternative embodiment would eliminate some or all of grooves 8. A groove 8 only opposite slot 12, for example, could be sufficient to retain the display plates 14 and graphics cards 16. Alternatively, other retention structures could be provided in place of grooves 8. For example, display plates 14 could be rigidly attached to graphics box 1 by adhesive or welding. Graphics cards 16 could be inserted between the display plates 14.

Figure 2:
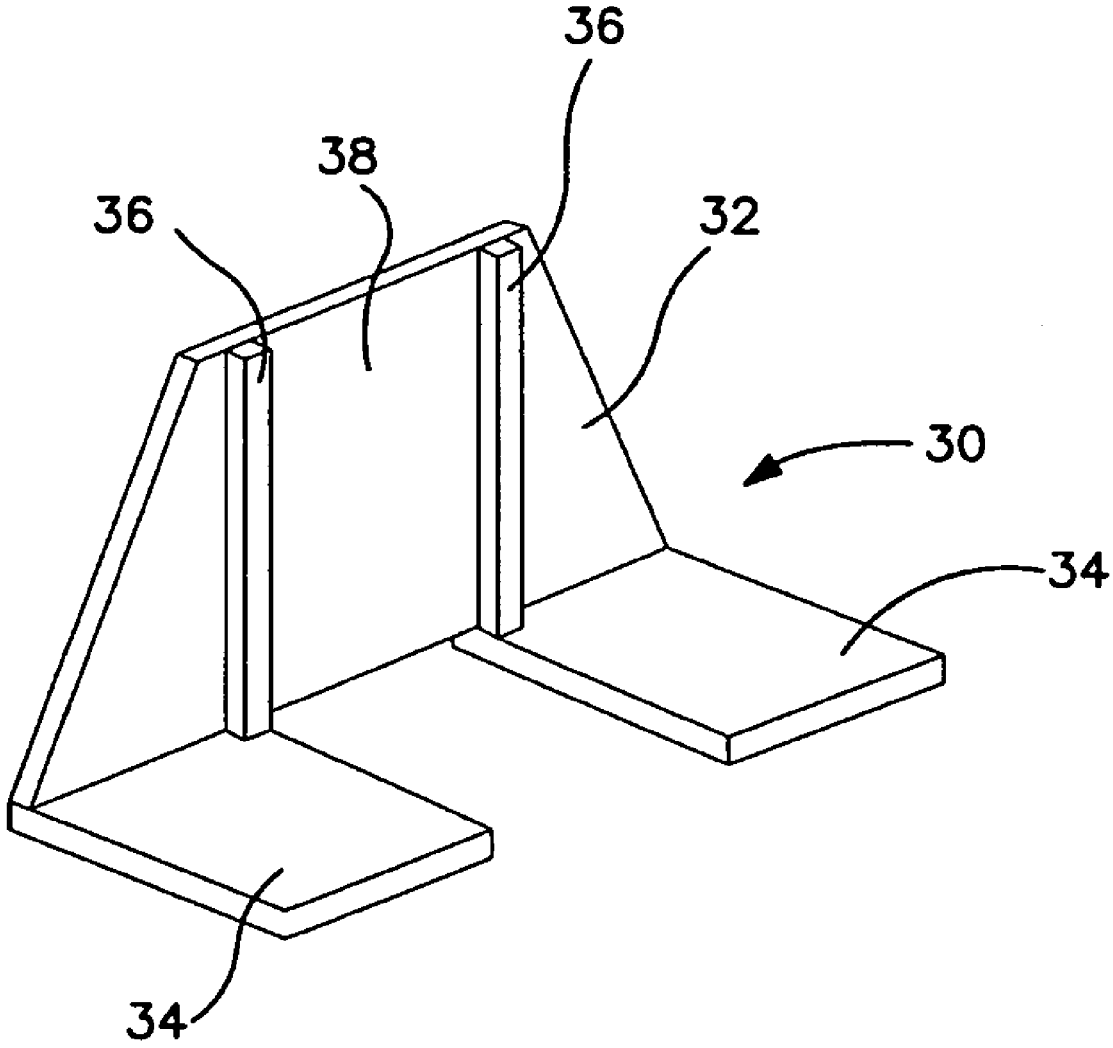
FIG. 2 is a perspective view of a supporting frame.
Figure 5:
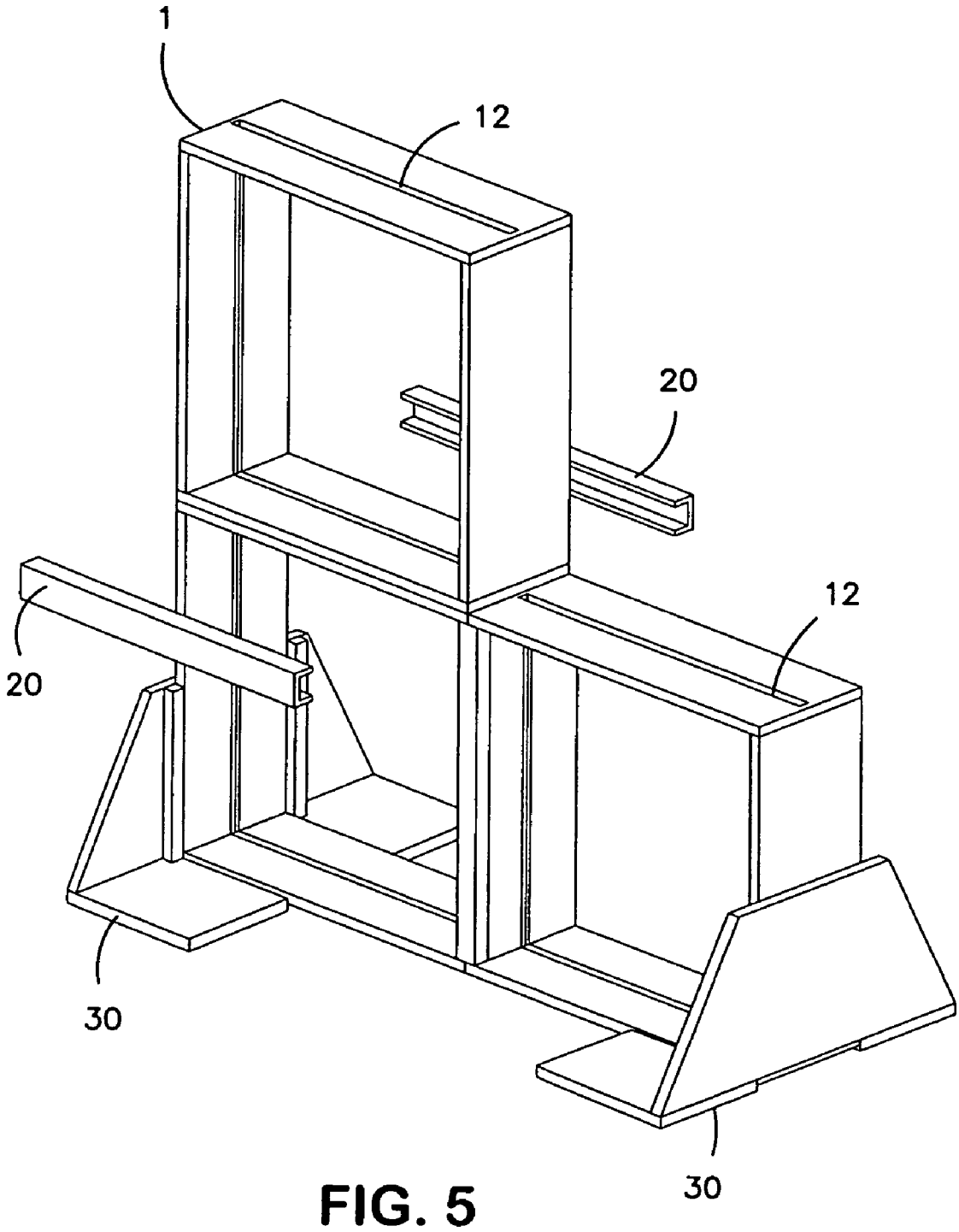
FIG. 5 is a perspective view of the graphics boxes and supporting frames of FIG. 4 with the clips in place and a third graphics box stacked thereon with additional clips in an exploded configuration.

FIG. 2 discloses a supporting frame 30 for use in supporting one or more graphics boxes 1. The supporting frame 30 is disposed about a bottom corner a graphics box 1. As best seen in FIG. 5, a bottom corner of graphics box 1 is disposed in the supporting frame with the horizontal portions 34 of the supporting frame disposed about the horizontal portion of the bottom corner of the graphics box. The vertical portion of the bottom corner of the graphics box is retained in slot 38 defined by the graphics box retaining rails 36 and the vertical portion 32 of the supporting frame 30.

Figure 3:
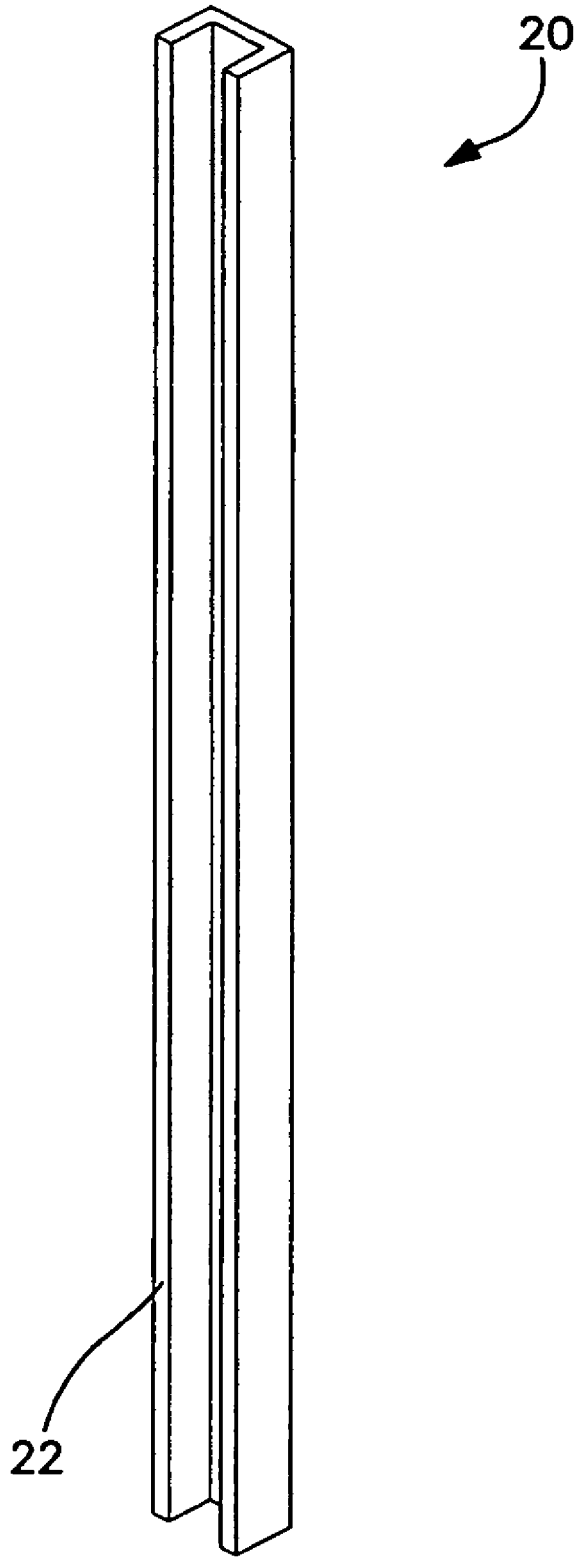
FIG. 3 is a perspective view of a clip.

The graphics box 1 may be utilized individually, but is most effectively utilized in groups. FIG. 5 shows three graphics boxes disposed in an L-shaped configuration. The bottom two graphics boxes are retained by the horizontal surface on which they are disposed as well as by the supporting frame 30. FIG. 3 discloses the structure of a clip 20 utilized to connect graphics boxes. By connecting graphics boxes to one another, the graphics boxes that are well supported by external supporting elements (e.g. floors, tables, walls, supporting frames 30, wires or any other elements which limit movement of graphics boxes) can support graphics boxes that are not supported by external supporting members.

Figure 4:
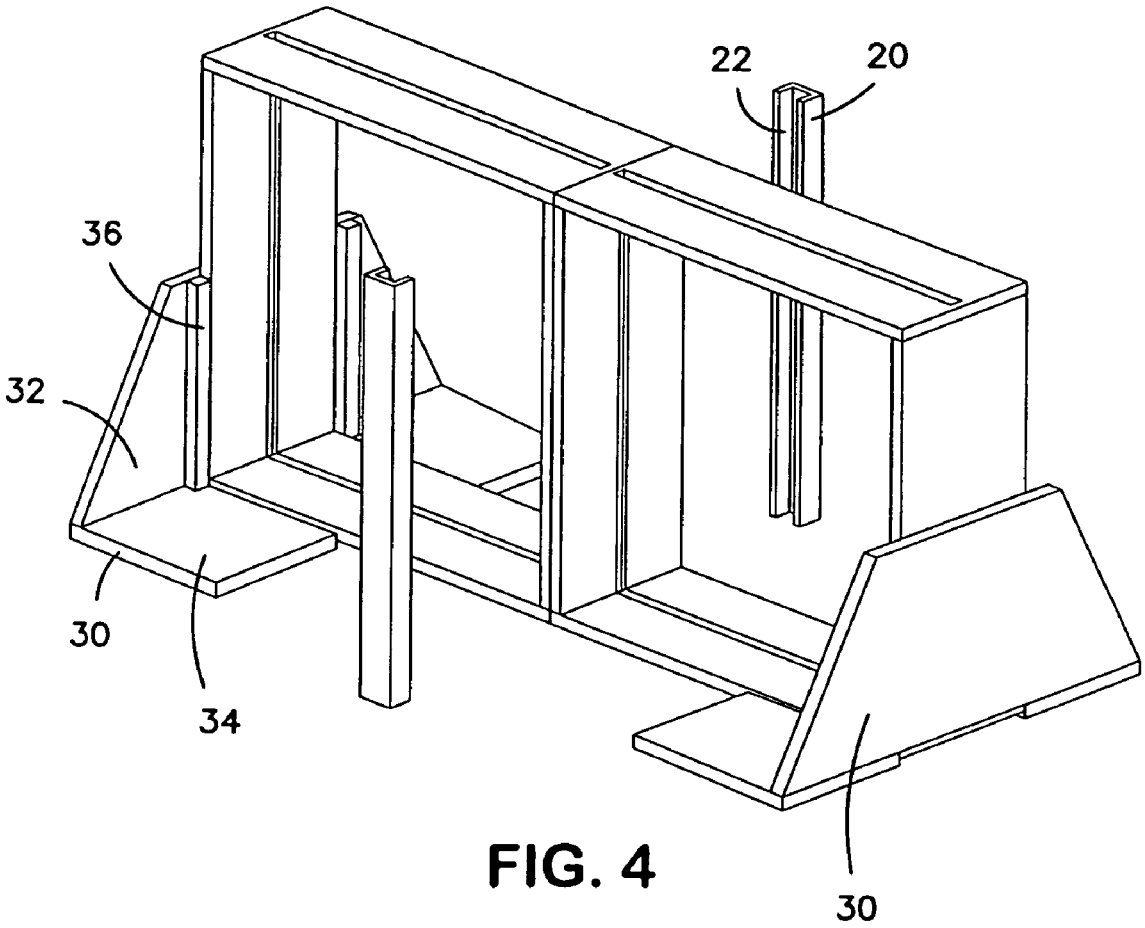
FIG. 4 is a perspective view of two graphics boxes supported by supporting frames, with clips shown in exploded configuration.

The clips 20 may be provided wherever a graphics box abuts another graphics box. Each clip is made from a resilient material and is provided with a central slot 22. Slot 22 has a width slightly smaller than the thickness of two frame elements. Thus, as best seen in FIGS. 4 and 5, clip 20 may be used to connect two abutting graphics boxes by sliding over the abutting frame elements each graphics box. The resilient nature of the clip 20 causes it to deform slightly when connecting two graphics boxes and exert a force which serves to retain the clip in place and transmit supporting forces from the supported graphics box to the unsupported graphics box.

FIG. 4 shows two graphics boxes 1 disposed in supporting frames 30. Two clips 20 are shown in exploded view. The clips will connect the two graphics boxes where they abut one another by sliding over the abutting frame elements, front and back, of each graphics box. FIG. 5 shows the exploded clips 20 from FIG. 4 in place and a third graphics box that has been stacked on one of the graphics boxes disposed in a supporting frame 30. Another pair of clips 20, again front and back, is shown in exploded view where the third graphics box abuts the graphics box disposed in supporting frame 30. Of course, before the third graphics box is stacked and clipped to the supported graphics box, the appropriate box insert 15 should be placed in the supported box.

Figure 6:
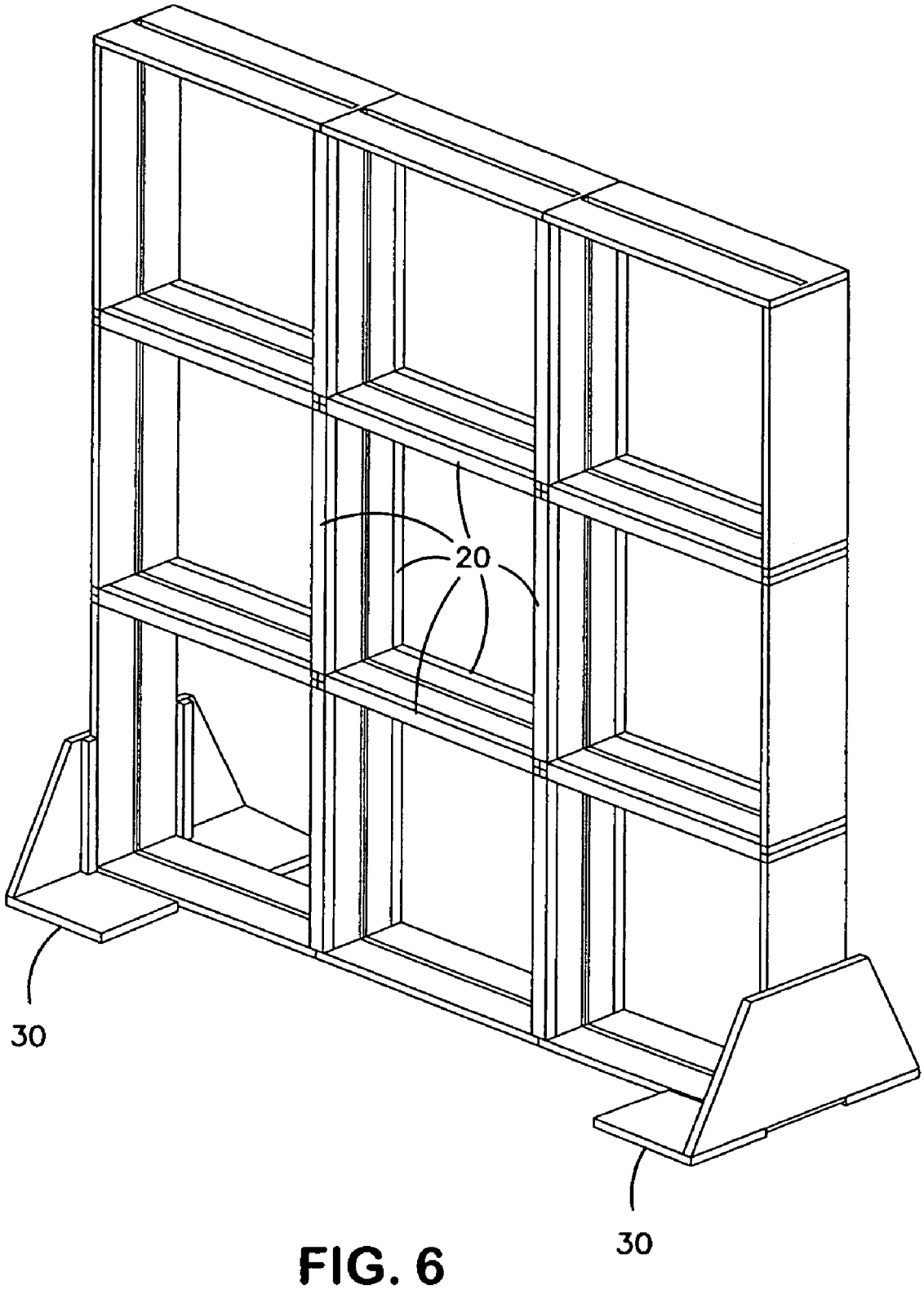
FIG. 6 is a perspective view of a 3×3 embodiment of the present invention.

FIG. 6 discloses one of many alternative graphics box groupings; this grouping is of nine identical graphics boxes 1 supported by two supporting frames 30 and twenty-four clips 20. The graphics boxes in FIG. 6 are arranged in a 3×3 configuration. For illustration purposes, no box inserts 15 are present in graphics boxes 1. However, in accordance with the present display system, a huge range of alternative graphics cards 16 may be displayed in these nine graphics boxes 1. In addition, it should be realized that the displayed message, picture of decoration viewed from one side of the display system need not be the same as that displayed from the other side of the display system.

Figure 7:
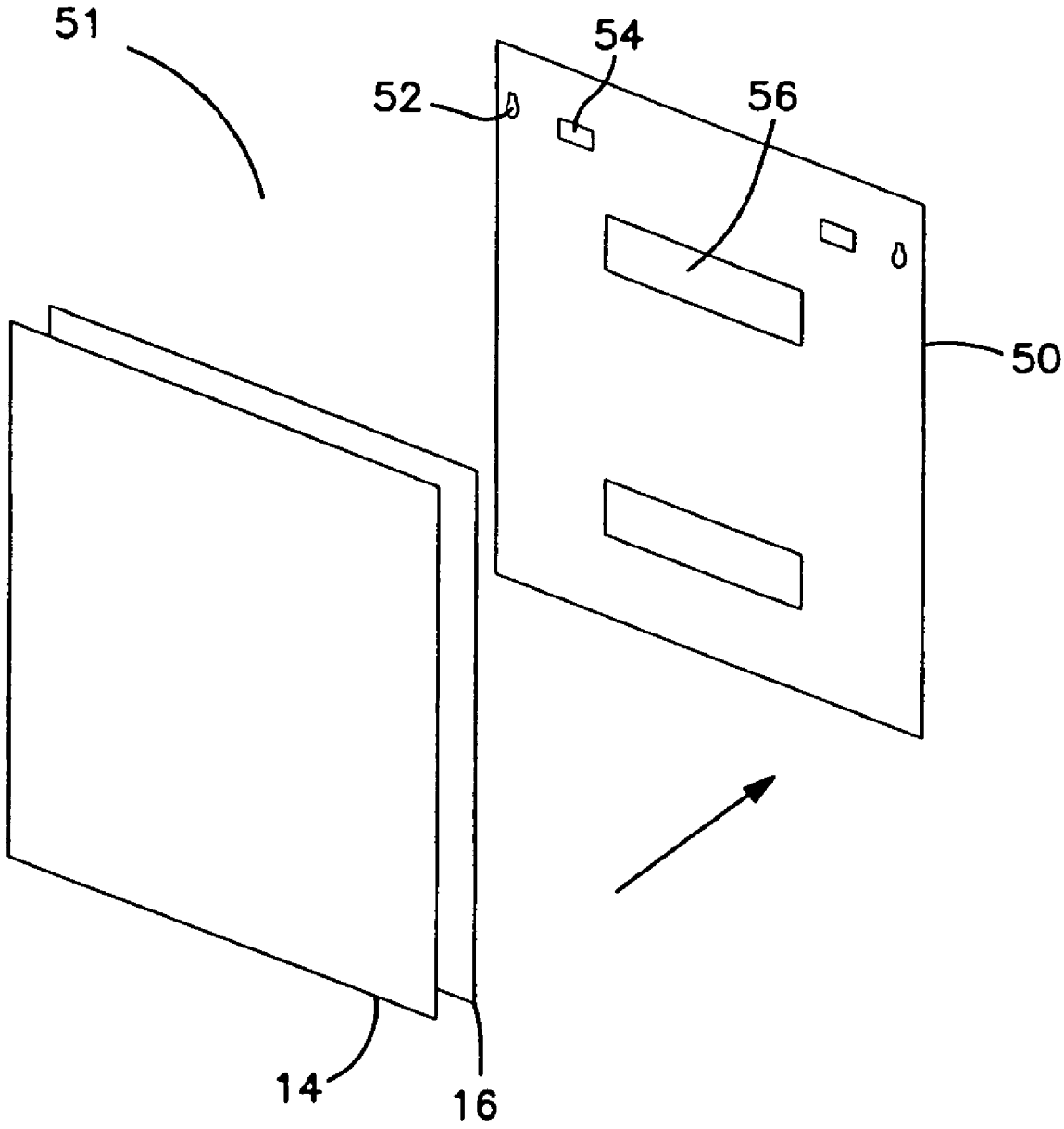
FIG. 7 is an exploded perspective view of an alternative embodiment of the display elements, including a mounting plate.

Another supporting structure is disclosed at FIGS. 7-10. This alternative supporting structure combines a mounting plate 50 and a mounting bracket 60. Mounting plate 50 may be used as an alternative to one of the display plates 14 disclosed in FIG. 1A. FIG. 7 discloses a graphics card 16 sandwiched between a display plate 14 and a mounting plate 50. The mounting plate 50 can be any rigid material and need not be transparent since it is not usually the function of the mounting plate 50 to allow graphics on graphics card 16 underlying it to be viewed.

Figure 10:
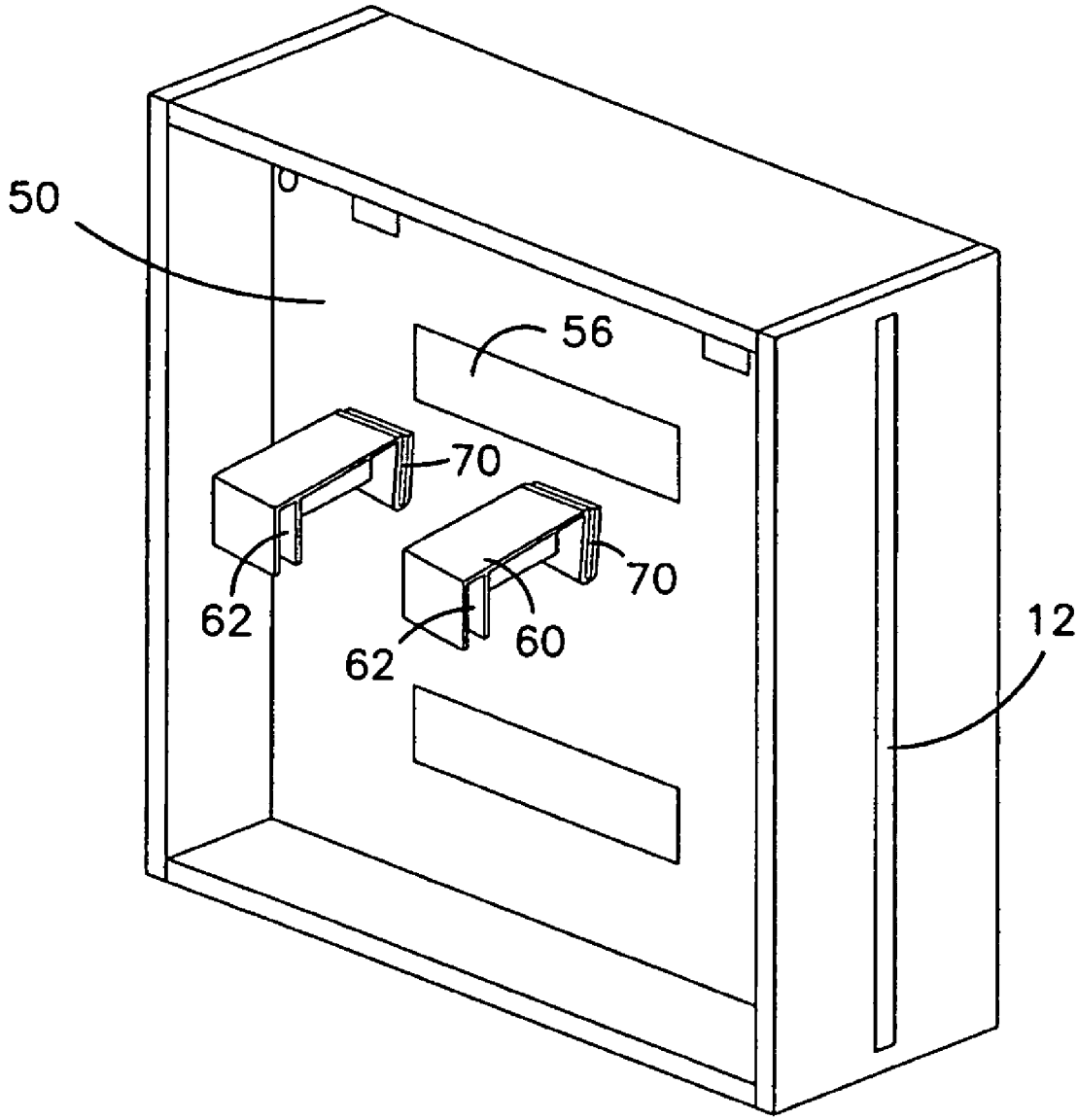
FIG. 10 is a perspective view of the mounting bracket disposed in the graphics box with two mounting brackets shown in exploded relationship.

Mounting plate 50 is of generally the same dimensions as display plate 14 such that it is used to sandwich graphics card(s) 16 and be inserted into the slot 12 of the graphics box 1 in generally the same way as described with respect to FIG. 1B. One difference between how the display structure including mounting plate 50, shown in FIG. 7, is inserted into the graphics box 1 is that the slot 12 must be vertically disposed upon insertion, as opposed to the horizontal disposition of slot 12 shown in FIG. 1B. This arrangement is shown in FIG. 10 and is necessary because vertical forces will be exerted on and by mounting plate 50 and if slot 12 is disposed horizontally, mounting plate 50 will be forced out of slot 12. Once disposed in graphics box 1, with slot 12 disposed vertically, mounting plate 50 enables the graphics box 1 to be supported by bracket 60.

Figure 8:
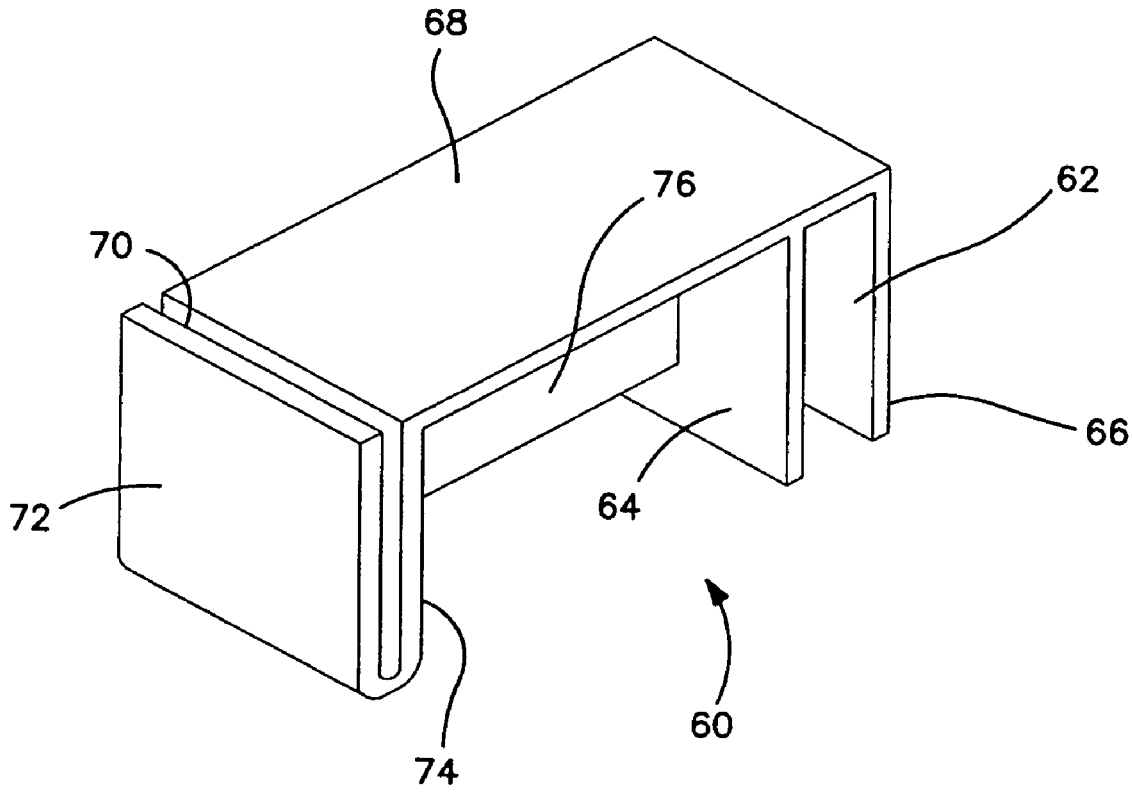
FIG. 8 is a perspective view of a mounting bracket

Bracket 60, as seen in FIG. 8, comprises a mounting plate slot 70 defined by mounting plate slot outer wall 72 and a mounting plate slot inner wall 74. Bracket 60 also comprises a hanging slot 62 defined by a hanging slot outer wall 66 and a hanging slot inner wall 64. The mounting plate slot 70 structure and the hanging slot 62 structure are connected by a mounting bracket main body 68 and strengthening rib 76.

Hanging slot 62 of bracket 60 may be disposed over any vertical supporting structure. Examples of a vertical supporting structure include a portion of a wall, a specialized structure extending from a wall or a supporting frame extending from any of a wall, a floor or even a ceiling. The mounting plate slot outer wall 72 may be disposed through opening 56 in mounting plate 50. Mounting plate 50 may then be lowered into slot 70. With slot 62 disposed over a supporting structure (not shown) and mounting plate 50 inserted into slot 70, mounting plate 50, and thus graphics box 1 is well supported.

Figure 9:
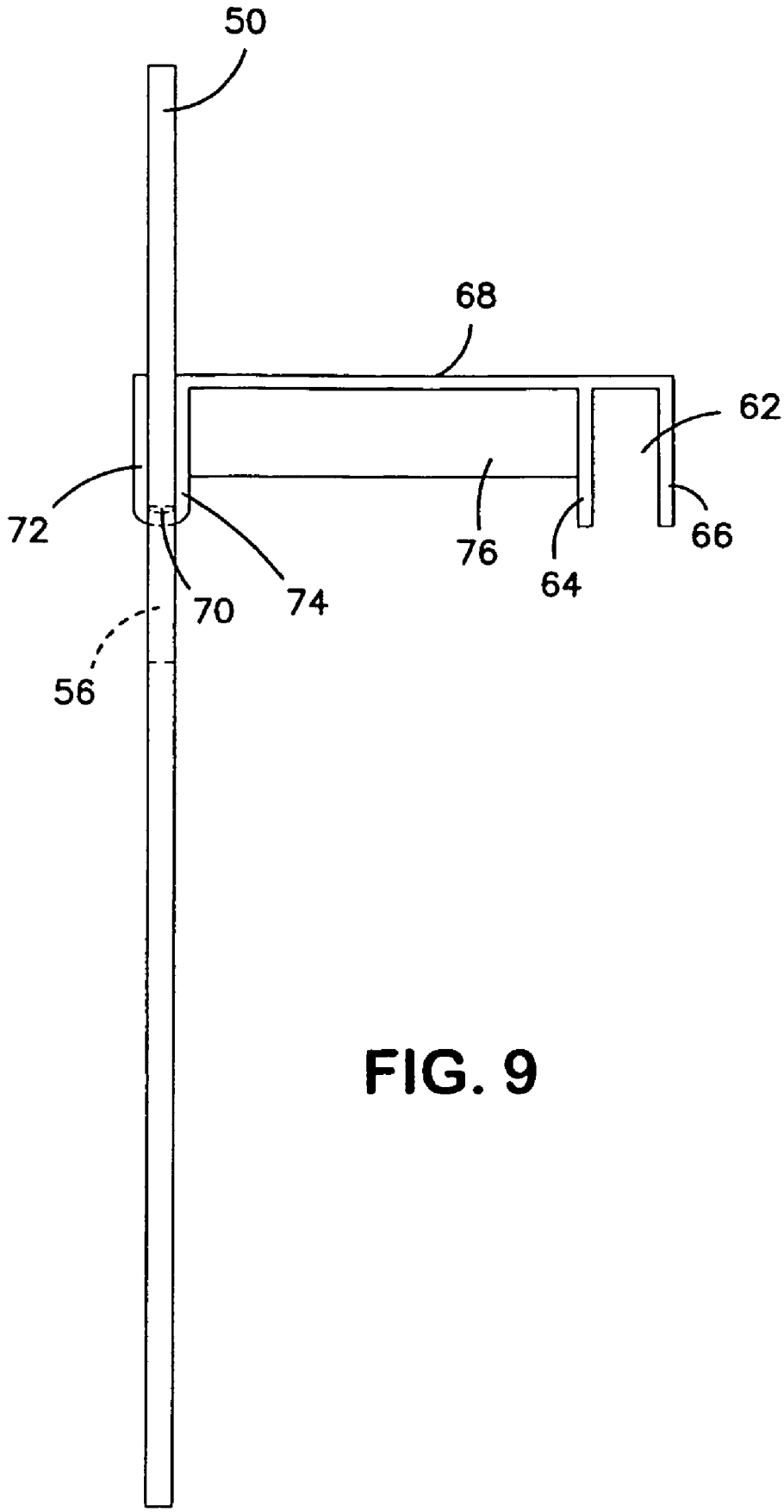
FIG. 9 is a side elevational view of the mounting bracket disposed in the mounting plate.

FIG. 9 shows mounting plate 50 and mounting bracket 60. Slot outer wall 72 is disposed through opening 56 in mounting plate 50 and mounting plate 50 is retained in slot 70. FIG. 10 shows mounting plate 50 and mounting brackets 60. Once the mounting brackets 60 are disposed through opening 56 and support mounting plate 50, mounting bracket support slot 62 may be disposed over a supporting structure and support the entirety of graphics box 1 and associated display elements.

FIG. 10 shows the mounting plate 50 utilized in conjunction with graphics box 1. Mounting brackets 60 are disclosed in exploded relationship with respect to the mounting plate 50, i.e. for the purposes of illustration the mounting brackets 60 are not engaged with the mounting plate 50. Once engaged, as shown in FIG. 9, the graphics box of FIG. 10 may be mounted on a supporting structure (not shown) which engages mounting bracket support slot 62.

While the foregoing invention has been described in some detail for purposes of clarity and understanding, it will be appreciated by one skilled in the art, from a reading of the disclosure, that various changes in form and detail can be made without departing from the true scope of the invention in the appended claims.

We claim:

1. A display system comprising:

a. a first graphics box comprising a plurality of first graphics box frame members defining a central display portion of the first graphics box, the first graphics box adapted to be selectively interconnected to at least a second graphics box, each of the plurality of first graphics box frame members comprising a substantially flat surface adapted to support the first graphics box in a substantially vertical position;

b. at least one graphics card disposed within the central display portion of the first graphics box;

c. a second graphics box comprising a second plurality of graphics box frame members, each of the plurality of second graphics box frame members comprising a substantially flat surface adapted to support the second graphics box in a substantially vertical position, any single one of the second graphics box frame members abutting any single one of the first graphics box frame members, the abutting frame members of the first and second graphics boxes defining an abutting region at which the graphics boxes are adapted to be removably joined;

d. a securing member having a slot sized to receive the abutting frame members thereby joining the first and second graphics boxes;

e. a frame slot extending through one frame member of the first graphics box adapted to provide access to the central display portion for the at least one graphics card; and f. at least one removable display plate adapted to be inserted into the frame slot comprising a substantially transparent surface for allowing the at least one graphics card to be viewed through the surface of the at least one display plate, the at least one display plate disposed adjacent the at least one graphics card in the frame slot;

wherein the display system is substantially free-standing;

g. a supporting frame disposed over a corner of the first graphics box and supporting the graphics box on a horizontal surface, wherein the supporting frame comprises:

a vertical portion attached to a plurality of retaining rails defining a supporting slot; and a plurality of horizontal portions perpendicularly attached to a bottom portion of the vertical portion;

wherein the corner of the first graphics box is retained in the supporting slot between the plurality of horizontal portions adjacent the horizontal surface.

2. The display system of claim 1 wherein the at least one display plate is comprised of essentially the same dimensions as the graphics card and being disposed over the graphics card occupying the central display portion.

3. The display system of claim 1, wherein the at least one display plate comprises essentially the same dimensions as the graphics card and is disposed over the graphics card occupying the central display portion; and wherein the slot through one frame member of at least the first graphics box provides access to the central display portion for the graphics card and the at least one display plate.

4. The display system of claim 1 further comprising:

a. a third graphics box comprising a plurality of third graphics box frame members, each of the plurality of third graphics box frame members comprising a substantially flat surface adapted to support the third graphics box in a substantially vertical position, any one of the third graphics box frame members abutting any one of either the first graphics box frame members or the second graphics box frame members.

5. The display system of claim 1 further comprising:

a. a second graphics card adapted to occupy at least the substantial portion of the central display portion of the first graphics box when inserted with the at least one graphics card.

6. A display system comprising:

a. a first graphics box comprising a first, a second, a third and a fourth frame member, the frame members defining a central display portion of the first graphics box, the first graphics box adapted to be selectively interconnected to other graphics boxes, each of the plurality of first graphics box frame members comprising a substantially flat surface adapted to support the first graphics box in a substantially vertical position;

b. at least one graphics card disposed within the central display portion of the first graphics box; and c. a second graphics box comprising a first, a second, a third and a fourth frame member, each of the plurality of second graphics box frame members comprising a substantially flat surface adapted to support the second graphics box in a substantially vertical position;

d. each of the first, second, third and fourth frame members of the first graphics box and the first, second, third and fourth frame members of the second graphics box being of complementary abutting structure such that any one of the frame members of the first graphics box may abut any one of the frame members of the second graphics box;

e. the first frame member of the first graphics box abutting the first frame member of the second graphics box;

f. a resilient clip disposed over the abutting frame members and removeably joining the first and second graphics boxes;

g. a frame slot extending through the first frame member providing access to the central display portion for the at least one graphics card; and h. at least one removable display plate adapted to be inserted into the frame slot comprising a substantially transparent surface for allowing the at least one graphics card to be viewed through the surface of the at least one display plate, the at least one display plate disposed adjacent the at least one graphics card in the frame slot;

wherein the display system is substantially free-standing;

i. a supporting frame disposed over a corner of the first graphics box and supporting the graphics box on a horizontal surface, wherein the supporting frame comprises:

a vertical portion attached to a plurality of retaining rails defining a supporting slot; and a plurality of horizontal portions perpendicularly attached to a bottom portion of the vertical portion; and wherein the corner of the first graphics box is retained in the supporting slot between the plurality of horizontal portions adjacent the horizontal surface.

7. The display system of claim 6 further wherein a third graphics box abuts the second frame member of the first graphics box and a fourth graphics box abuts the third frame member of the first graphics box.

8. The display system of claim 7, wherein a fifth graphics box abuts the fourth frame member of the first graphics box.

9. A display system comprising:

a. a first graphics box comprising a plurality of first graphic box frame members defining a central display portion of the first graphics box, the first graphics box adapted to be selectively interconnected to other graphics boxes, each of the plurality of first graphics box frame members comprising a substantially flat surface adapted to support the first graphics box in a substantially vertical position;

b. at least one graphics card disposed within the central display portion of the first graphics box;

c. a second graphics box comprising a second plurality of graphics box frame members, each of the plurality of second graphics box frame members comprising a substantially flat surface adapted to support the second graphics box in a substantially vertical position, any single one of the second graphics box frame members abutting any single one of the first graphics box frame members, the abutting frame members of the first and second graphics boxes defining an abutting region at which the graphics boxes are adapted to be removably joined;

d. a resilient clip having a slot whose width is less than the width of the abutting frame members which are received within the slot to removeably join the first and second graphics boxes;

e. a frame slot extending through one frame member of the first graphics box providing access to the central display portion for the at least one graphics card; and f. at least one removable display plate adapted to be inserted into the frame slot comprising a substantially transparent surface for allowing the at least one graphics card to be viewed through the surface of the at least one display plate, the at least one display plate disposed adjacent the at least one graphics card in the frame slot;

wherein the display system is substantially free-standing g. a supporting frame disposed over a corner of the first graphics box and supporting the graphics box on a horizontal surface, wherein the supporting frame comprises:

a vertical portion attached to a plurality of retaining rails defining a supporting slot; and a plurality of horizontal portions perpendicularly attached to a bottom portion of the vertical portion; and wherein the corner of the first graphics box is retained in the supporting slot between the plurality of horizontal portions adjacent the horizontal surface.

10. The display system of claim 9 wherein the at least one display plate is comprised of essentially the same dimensions as the graphics card and being disposed over the graphics card occupying the central display portion.

11. A display system comprising:

a. a first graphics box comprising a plurality of first graphics box frame members defining a central display portion of the first graphics box, the first graphics box adapted to be selectively interconnected to at least a second graphics box, each of the plurality of first graphics box frame members comprising a substantially flat surface adapted to support the first graphics box in a substantially vertical position;

b. at least one graphics card disposed within the central display portion of the first graphics box;

c. a second graphics box comprising a second plurality of graphics box frame members, each of the plurality of second graphics box frame members comprising a substantially flat surface adapted to support the second graphics box in a substantially vertical position, any single one of the second graphics box frame members abutting any single one of the first graphics box frame members, the abutting frame members of the first and second graphics boxes defining an abutting region at which the graphics boxes are adapted to be removably joined;

d. a securing member having a slot sized to receive the abutting frame members thereby joining the first and second graphics boxes;

e. a frame slot extending through one frame member of the first graphics box adapted to provide access to the central display portion for the at least one graphics card; and f. at least one removable display plate adapted to be inserted into the frame slot comprising a substantially transparent surface for allowing the at least one graphics card to be viewed through the surface of the at least one display plate, the at least one display plate disposed adjacent the at least one graphics card in the frame slot;

wherein the display system is substantially free-standing;

g. a mounting plate disposed in the central display portion of the first graphics box adjacent the graphics card; and h. a bracket engaged with the mounting plate and having a mounting portion capable of engaging a vertical mounting element, the bracket comprising:

a mounting plate slot defined by a mounting plate slot outer wall and an mounting plate slot inner wall, the mounting plate slot for housing the mounting plate when the bracket is inserted through an aperture in the mounting plate and engaged with the mounting plate;

a hanging slot defined by a hanging slot outer wall and a hanging slot inner wall adapted to be disposed over the vertical mounting element;

a mounting bracket body extending from the mounting plate slot inner wall to the hanging slot outer wall; and a strengthening rib attached to the mounting bracket body extending from the mounting plate slot inner wall to the hanging slot inner wall.

12. The display system of claim 11, wherein the at least one display plate is comprised of essentially the same dimensions as the graphics card and being disposed over the graphics card occupying the central display portion.

13. The display system of claim 11, wherein the at least one display plate comprises essentially the same dimensions as the graphics card and is disposed over the graphics card occupying the central display portion; and wherein the slot through one frame member of at least the first graphics box provides access to the central display portion for the graphics card and the at least one display plate.

14. The display system of claim 11 further comprising:

i. a third graphics box comprising a plurality of third graphics box frame members, each of the plurality of third graphics box frame members comprising a substantially flat surface adapted to support the third graphics box in a substantially vertical position, any one of the third graphics box frame members abutting any one of either the first graphics box frame members or the second graphics box frame members.

15. A display system comprising:

a. a first graphics box comprising a plurality of first graphic box frame members defining a central display portion of the first graphics box, the first graphics box adapted to be selectively interconnected to other graphics boxes, each of the plurality of first graphics box frame members comprising a substantially flat surface adapted to support the first graphics box in a substantially vertical position;

b. at least one graphics card disposed within the central display portion of the first graphics box;

c. a second graphics box comprising a second plurality of graphics box frame members, each of the plurality of second graphics box frame members comprising a substantially flat surface adapted to support the second graphics box in a substantially vertical position any single one of said second graphics box frame members abutting any single one of said first graphics box frame members, the abutting frame members of the first and second graphics boxes defining an abutting region at which the graphics boxes are adapted to be removably joined;

d. a resilient clip having a slot whose width is less than the width of the abutting frame members and whose length is less than the length of a first or second box frame member, the abutting frame members received within the slot to removeably join the first and second graphics boxes;

e. a frame slot extending through one frame member of the first graphics box providing access to the central display portion for the at least one graphics card; and f. at least one removable display plate adapted to be inserted into the frame slot comprising a substantially transparent surface for allowing the at least one graphics card to be viewed through the surface of the at least one display plate, the at least one display plate disposed adjacent the at least one graphics card in the frame slot;

wherein the display system is substantially free-standing;

g. a mounting plate disposed in the central display portion of the first graphics box adjacent the graphics card; and h. a bracket engaged with the mounting plate and having a mounting portion capable of engaging a vertical mounting element, the bracket comprising:

a mounting plate slot defined by a mounting plate slot outer wall and an mounting plate slot inner wall, the mounting plate slot for housing the mounting plate when the bracket is inserted through an aperture in the mounting plate and engaged with the mounting plate;

a hanging slot defined by a hanging slot outer wall and a hanging slot inner wall adapted to be disposed over the vertical mounting element;

a mounting bracket body extending from the mounting plate slot inner wall to the hanging slot outer wall; and a strengthening rib attached to the mounting bracket body extending from the mounting plate slot inner wall to the hanging slot inner wall.

* * * * *